US005588539A

United States Patent [19]

Belden, Jr. et al.

[11] Patent Number: 5,588,539

[45] Date of Patent: Dec. 31, 1996

[54] PLASTIC DISH DRAINER HAVING INTEGRAL CUP AREA

[75] Inventors: Dennis D. Belden, Jr., Akron; Keith E. Brightbill, Wooster; Stephen P. Casteel, Wadsworth; Charles W. Craft, Apple Creek; Diana W. Juratovac, Columbus, all of Ohio

[73] Assignee: Rubbermaid Incorporated, Wooster, Ohio

[21] Appl. No.: 355,548

[22] Filed: Dec. 14, 1994

[51] Int. Cl.[6] ..... A47F 7/00

[52] U.S. Cl. ..... 211/41

[58] Field of Search ..... 211/41, 74; D44/99; D32/55

[56] References Cited

U.S. PATENT DOCUMENTS

| | | | |
|---|---|---|---|
| D. 164,197 | 8/1951 | Planeta | D44/29 |
| D. 174,073 | 2/1955 | Bliss | D44/29 |
| D. 212,301 | 9/1968 | Taylor | D44/29 |
| D. 214,524 | 6/1969 | Taylor | D44/29 |
| D. 215,170 | 9/1969 | Bachand | D44/29 |
| D. 259,537 | 6/1981 | Taylor | D7/188 |
| D. 265,262 | 6/1982 | Taylor | D32/55 |
| D. 268,878 | 5/1983 | Taylor | D32/55 |
| D. 271,340 | 11/1983 | Taylor | D32/55 |
| D. 345,834 | 4/1994 | Craft et al. | D32/55 |
| D. 353,921 | 12/1994 | Lippisch | D32/55 |
| D. 353,922 | 12/1994 | Drake | D32/55 |
| D. 353,923 | 12/1994 | Drake | D32/55 |
| 986,265 | 3/1911 | Boss . | |
| 1,252,220 | 1/1918 | Benson . | |
| 1,389,908 | 9/1921 | Dunn . | |

(List continued on next page.)

OTHER PUBLICATIONS

Sell sheet, Dish drainers; Ingrid, 1419 Lake Cook Road, Suite 200, Deerfield, Illinois 60015. Published at least as early as Aug. 12, 1990.

Catalog page, Dish drainers; Tucker Housewares, 25 Tucker Drive, Leominister, Massachusetts 01469. Publication date 1989.

Pp. 16 and 17, Dish drainers;Tucker Housewares, 25 Tucker Drive, Leominister, Massachusetts 01469. Published at least as early as Dec., 1991.

Catalog page, Dish drainers; Nova Housewares, C/–Kader Plastics Pty. Ltd., Hume Highway, PO Box 42, Craigieburn, Victoria 3064 Australia. Published at least as early as 1991.

Sell sheet, Dish drainers; Sterilite Corporation, 198 Main Street, P. O. Box 524, Main Street, Townsend, Massachusetts. Publication date 1991.

Catalog page, Dish drainers; Sterilite Corporation, 198 Main Street, P. O. Box 524, Main Street, Townsend, Massachusetts. Publication date 1991.

P. 28, Dish drainers; Dupol–Rubbermaid GmbH; An der Trift, D–6072 Dreieich, Germany. Publication date 1989.

P. 6, Dish drainers; Rubbermaid Incorporated, 1147 Akron Road, Wooster, Ohio 44691. Publication date 1986.

P. 5, Dish drainers; Rubbermaid Incorporated, 1147 Akron Road, Wooster, Ohio 44691. Publication date 1986.

*Primary Examiner*—Alvin C. Chin-Shue
*Assistant Examiner*—Sarah L. Purol
*Attorney, Agent, or Firm*—Richard B. O'Planick; Lisa B. Riedesel

[57] ABSTRACT

A dish draining rack (10) is disclosed comprising a central upwardly opening chamber (12) defined by longitudinal side panels (18,20) and end panels (26,28). The side panels ( 18, 20) are formed to include a series of convoluted concave depressions (30) defined by concave depress(on side walls (32). Edge portions (40) ofthe floor surface (16) cant downward from the center to the side panels (18,20), and a passageway (34) is positioned below each depression (30) and extends through the floor surface (16). An inverted glass positioned upon the edge surface portion (40) tilts into one of the depressions (30) where it is supporied by the depression concave side walls (32). So positioned, water in the glass collects and travels along an outward surface of the glass to the floor surface (16) and thence through the passageways (34) through the floor edge portions (40) to a mat below the rack.

16 Claims, 4 Drawing Sheets

U.S. PATENT DOCUMENTS

| | | | |
|---|---|---|---|
| 1,682,654 | 8/1928 | Andrews . | |
| 2,697,525 | 12/1954 | Breneman | 211/41 |
| 2,864,509 | 12/1958 | Watral | 211/41 |
| 3,027,041 | 3/1962 | Stansbury et al. | 220/21 |
| 3,442,395 | 5/1969 | Taylor | 211/41 |
| 4,221,299 | 9/1980 | Taylor | 211/41 |
| 4,372,448 | 2/1983 | Drach | 211/41 |
| 4,485,930 | 12/1984 | Savelkouls | 211/74 |
| 4,660,727 | 4/1987 | Levine | 211/74 |
| 4,726,475 | 2/1988 | Ferenzi | 211/126 |
| 4,998,631 | 3/1991 | Fridjhon | 211/74 |
| 5,158,184 | 10/1992 | Craft et al. | 211/41 |
| 5,385,261 | 1/1995 | Lippisch et al. | 220/572 |

PLASTIC DISH DRAINER HAVING INTEGRAL CUP AREA

BACKGROUND OF THE INVENTION

1. Field of the Invention

The subject invention relates generally to dish draining racks and, more specifically, to such racks that incorporate integral structure for receiving and supporting beverageware.

2. The Prior Art

Dish draining racks are popular consumer items. Typically such products comprise a molded plastic, or wire box-shaped body, having a central chamber for receiving and supporting dishes in an inverted condition. The bottom floor of conventional racks have openings therethrough to allow wash water from the dishes to drain through the rack and onto a mat placed therebeneath, from which the water is channeled into a sink. U.S. Design Pat. No. 345,834 shows such a dish rack.

Alternatively, some currently available dish racks are formed of plastic coated wire, as illustrated by Design Pat. No. 174,073. They likewise have a central chamber defined by a bottom floor and sidewalls, and the chamber includes upstanding rack panels that support dishes on edge.

The aforementioned commercial racks typically include glass supporting posts along one or more sidewalls. The posts project upward in cantilevered fashion from a bottom of the rack to a top of the sidewall. Glasses are inverted and placed over the top ends of the posts to dry. The glasses so positioned are located outside of the sidewalls of the panels and hang in such a manner that water exiting the glasses falls to the outside of the rack sidewalls.

While the described state of the art dish racks work well and have been well received, certain shortcomings prevent them from representing an optimum solution to the industry's needs. First, the glasses, when inverted and mounted over the posts, hang outside of the rack and tend to overhang the mat positioned therebeneath. Water dropping from the glasses can miss the underlying mat and thereby avoid direction into the adjacent sink.

Moreover, the glasses hanging to the outside of the rack utilize space. In applications where such space is at a premium, the space occupied by the hanging glasses may by unavailable and the utility of the rack compromised thereby. In addition, the glasses hanging to the outside of the rack are exposed to inadvertent contact and can be dislodged from the posts. So dislodged, the glasses can fall and break.

SUMMARY OF THE INVENTION

The present invention overcomes the aforementioned deficiencies in commercially available dish racks by providing a dish rack having integral internal recesses for receiving and maintaining glasses in an inverted, tilted condition, such that water dropping from the glasses passes through the floor of the rack and directly upon the mat therebeneath. The rack comprises a four-sided body having a central chamber extending from a floor to a top rim. Opposite side panels of the rack have a series of inwardly opening recesses that each individually receive an inverted glass. The floor of the rack is canted downward from the center to the opposed side panels such that an inverted glass resting thereupon is leaning into its respective recess. So tilted, water from the glass exits along an outward surface of the glass to the floor surface. Through passages are provided through the chamber floor, proximately positioned adjacent the side panel recesses. The water dropping from the tilted glasses is directed through the passageways to the collection mat below the rack.

Accordingly, it is an objective of the present invention to provide a dish draining rack having internal, integral glass receiving recesses.

A further objective is to provide a dish rack creating a protective enclosure for inverted glasses.

Still a further objective is to provide a dish rack having a relatively small footprint when full.

Yet another objective is to provide a dish rack having structural means for limiting glass breakage.

A further objective is to provide a dish rack having improved means for channeling essentially all dish water to an underlying mat.

Another objective is to provide a dish rack integrally formed by conventional means in an economical manner.

These and other objectives, which will be apparent to those skilled in the art, are incorporated in a preferred embodiment which is described in detail below and which is illustrated by the accompanying drawings.

DESCRIPTION OF THE ACCOMPANYING DRAWINGS

DESCRIPTION OF THE PREFERRED EMBODIMENT

Figure 1:
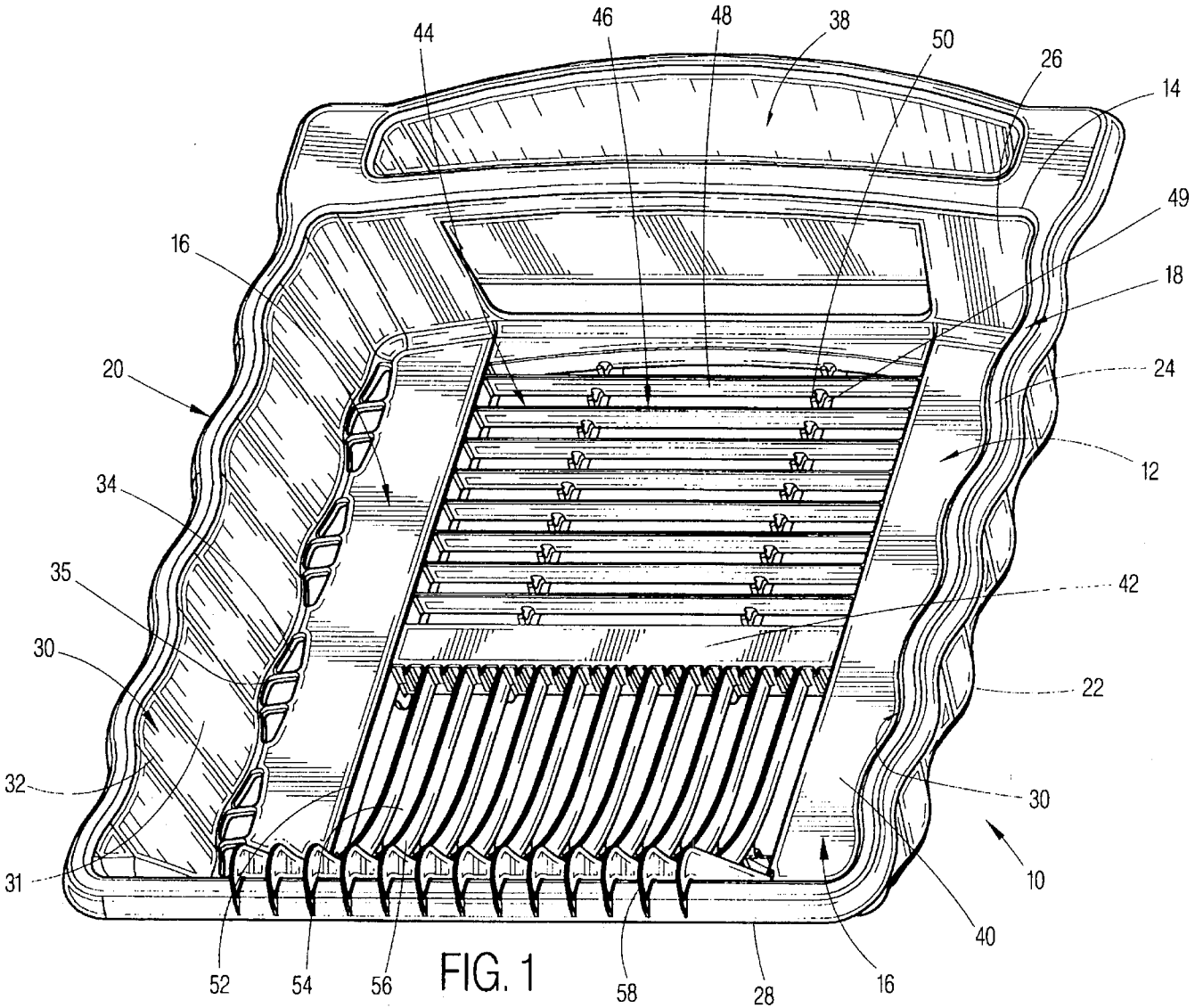
FIG. 1 is a front top perspective of the subject dish rack.

Referring to FIGS. 1–4, the subject dish draining rack 10 is an integrally molded body, formed of conventional plastic material such as polypropylene by conventional manufacturing means such as injection molding. The rack 10 is intended for use upon a mat (not shown) on a counter top, adjacent to a sink. The purpose of the rack 10 is to accommodate the receipt of washed dishes in an inverted condition, so that the dishes can drain and dry for storage.

The rack 10 is formed to provide a central, upwardly opening, rectangular chamber that extends from a downturned top rim 14 to a floor surface 16. The chamber 12 is defined by opposite longitudinal first and second side panels 18,20, each of which extending from a side panel bottom end 22 to a side panel top end 24 located at the top rim 14. The chamber is further defined by a forward end panel 26 and a rearward end panel 28 that complete the four sides that enclose the chamber 12.

As shown, each of the longitudinal side panels 18,20 has a serpentine, corrugated shape, comprising a series of U-shaped depressions 30 extending therealong, each depression 30 separated from an adjacent depression by a raised shoulder portion 31 and being defined by inwardly opening concave depression surfaces 32. The series of depressions 30 extend from the forward end panel 26 to the rearward end panel 28, and number four to a side panel in the preferred embodiment. The concave surfaces 32 of each depression extend from the top rim 14 to the floor surface 16 in a continuous manner, and combine with adjacent surfaces 32 to form a continuous wave shaped surface along both sides of the chamber 12.

Continuing, the rack 10 is provided with a series of four passageways 34 extending through the floor surface 16 to an underside 36 of the rack. Each passageway 34 is of generally an elliptical shape, trifurcated by two transverse ribs 35. The shape of the passageways 34 can be varied, however, without departing from the invention. The location of the passageways 34 are such that one passageway 34 is located below one of the depressions 30, along opposite sides of the chamber 12. The passageways 34 are located at the intersection of the surfaces 32 of each depression with the floor surface 16.

Figure 4:
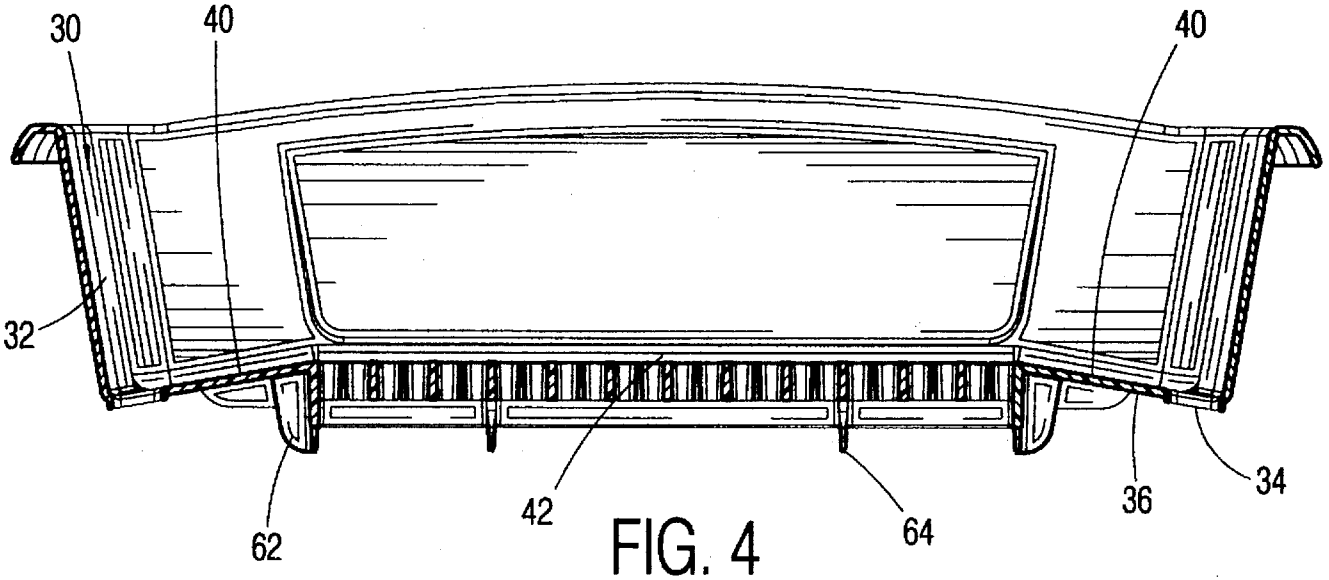
FIG. 4 is a transverse section view thereof taken along the line 4—4 of FIG. 2.

A utensil container 38 is included in the rack 10, positioned outside of the forward end panel 26. The container 38 opens upwardly and has passageways extending through a bottom floor surface through which water drains. As best shown in FIG. 4, longitudinal edge portions 40 of the floor surface 16 cant downwardly from a flat central portion 42 of the surface 16 to the side panels 18,20. The floor surface 16 is thus generally downwardly concave, being flat at the central portion 42 and sloping downward by the edge portions 40.

Figure 2:
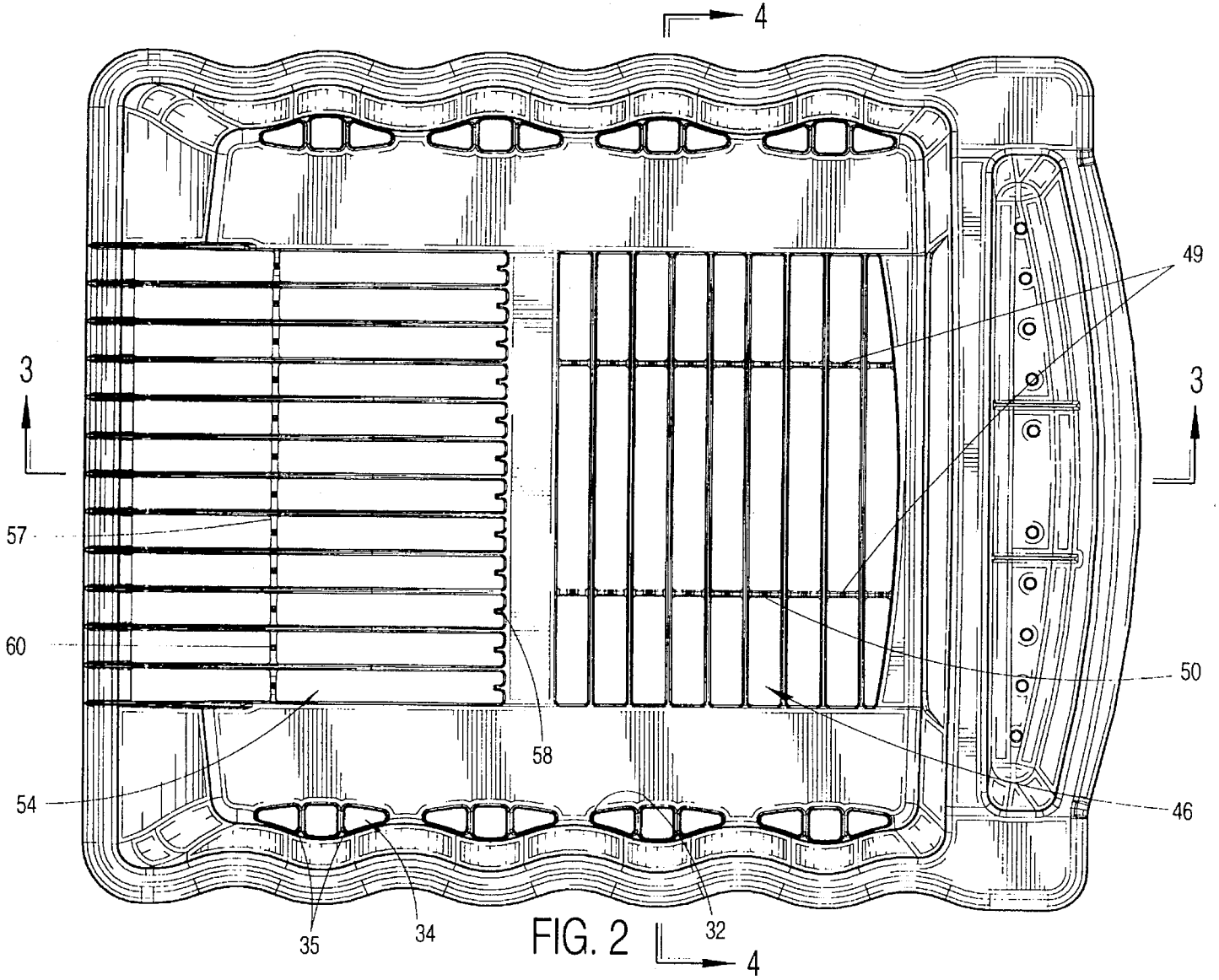
FIG. 2 is a top plan view thereof.

The central portion 42 of the floor surface is configured to provide a forwardly disposed, upward projecting dish supporting rack 44, comprising transverse slots 46 separated by transverse ribs 48. As best shown by FIGS. 1 and 2, two parallel longitudinal reinforcement flanges 49 extend across the forward rack 44, and provide a series of upwardly projecting fingers 50, each finger projecting upward from its position on one of the flanges 49 into a respective one of the slots 46. The fingers divide the slot 46 into which it projects in two, such that by abutting a dish edge against either side of the finger 50 and leaning the dish against one of the transverse ribs 48, the dish is supported in an on-edge leaning orientation for drying.

A rearward dish rack 52 is further formed to project upward from a rearward portion of the central floor portion 42. The rack 52 is formed by longitudinal ribs 56 separated by longitudinal slots 54. The ribs curve upward from the floor surface and over a rearward portion of the upper rim 14. A transversely extending reinforcement flange 57 extends below and across the ribs 56, and a plurality of upward divider fingers 60 extend upward, each finger 60 projecting into one of the slots 54 and dividing the slot in two. A plurality of second divider fingers 58 project into the slots 54 from the inward ends, one of the fingers 58 for each slot 54. The flange 57 supports plates on edge, with an edge of each plate abutting the fingers 58, 60 and the plate then leaning against the ribs 56.

Figure 3:
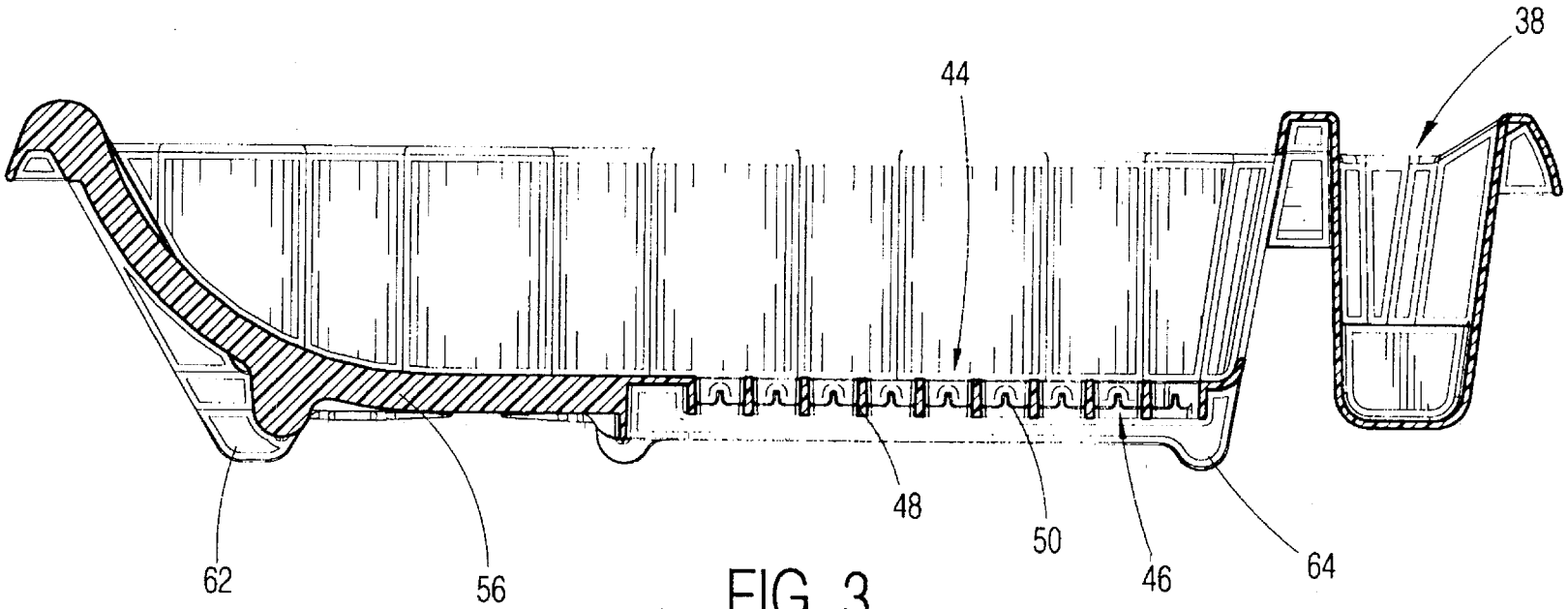
FIG. 3 is a longitudinal section view thereof taken along the line 3—3 of FIG. 2.

As shown in FIGS. 3 and 4, a pair of rearward molded legs 62 and a pair of forward molded legs 64 support the rack 10 in a freestanding condition. It will be appreciated that the rack 10 is supported by a mat (not shown), with longitudinal side edges of the mat extending just beyond the side panels 18,20. So positioned, dishes positioned in either the forward rack 44 or the rearward rack 52 drain down through the central floor portion 42 to the mat below. The mat has a portion that overhangs the edge of a sink or the like, and slopes toward that edge such that water collected upon the mat is channeled into the sink.

The operation of the convoluted depressions 30 along the edge portions 40 of the floor will be appreciated by a collective consideration of FIGS. 1–4. Glasses are positioned inside of the side panels 18, 20 in an inverted condition, each glass inside of one depression 30 and having a lower edge on the floor edge portions 40. Due to the downward cant of edge portions 40, the glass assumes a leaning orientation and is supported by the depression concave side walls 32. The side walls 32 are radiussed to correspond in size to a glass curvature so that the body of a glass may enter the depression 30 and be closely held by the side walls 32. So positioned, any water in the glass travels along an outward surface of the glass to the floor edge portion 40 below the depression 30, and then through the passageways 34 to the mat below.

The water dripping from the glasses passes through the rack within the confines of the panels 18, 20 and 26,28, and is collected by the mat below. No water therefore can escape and fall outside of the periphery of the mat below. Moreover, it will be appreciated that the glasses leaning into the depressions 30 are protected by the side panels 18,20 from breakage, or inadvertent contact. They cannot therefore fall from the rack as with conventional racks that place the glasses to the outside of the side panels for drying. Finally, it will be appreciated that the footprint of the rack 10 with glasses and plates located entirely within the confines of the side panels is relatively small, making the rack usable on counters where space is at a premium. Neither the rack nor the beverageware supported thereby extend outward beyond the mat on which it is positioned. No water therefore drops outside of the mat.

While the above describes a preferred embodiment of the subject invention, the invention is not intended to be so limited. Other embodiments, which utilize the teachings herein set forth and which will be apparent to those skilled in the art, are intended to be within the scope and spirit of the invention.

We claim:

1. A dish draining rack comprising:

a rack body for containng assorted dishware, the rack body having a central. upward opening dishware receiving chamber extending from a top rim to a floor surface and defined along opposite sides by a first side panel and a second side panel, the side panels imersecting the floor surface at a bottom end and extending upward therefrom to a top end; and at least one of the side panels having an inwardly opening, substantially vertical depression imegrally formed to extend therein defined by depression sidewalls sized to receive and support an inverted glass and maintain the glass in an inverted condition within the one side panel, whereby water from the inverted glass is directed to the chamber floor surface.

2. A rack according to claim 1, wherein an upper rim of the inverted glass is supported by the chamber floor surface proximate to the intersection of the one side panel and the floor surface.

3. A rack according to claim 2, wherein the floor surface having a passageway extending therethrough located proximate to the one side panel depression, the passageway receiving the water from the inverted glass and directing it through the rack floor surface to an underside surface.

4. A rack according to claim 3, wherein the floor surface slopes downward toward the intersection of the one side panel and the floor surface, and the passageway is located proximate to the intersection of the one side panel and the floor surface.

5. A rack according to claim 4, wherein the depression sidewalls flare outwardly from a bottom end to a top end and support the inverted glass in a tilted orientation, whereby the water from the glass exits along an outwardly located inward surface of the glass.

6. A rack according to claim 5, wherein the depression sidewalls are concave and smooth.

7. A rack according to claim 6, wherein the one side panel has a plurality of like configured depressions positioned adjacent to the one depression, each said depression separated from an adjacent depression by a raised ridge, and the rack having a passageway proximate a lower end of each said depression extending through the chamber floor surface.

8. A rack according to claim 7, wherein the chamber floor surface slopes downward toward the bottom ends of the first and second panels and comprises a central raised floor portion, the rack body further including dish supporting means located upon the central floor portion for supporting a plurality of dishware items.

9. A dish draining rack comprising:

a rack body for containing assorted dishware, the rack body having a central upward opening dishware receiving chamber extending from a top rim to a floor surface and defined along opposite sides by a first side panel and a second side panel, the side panels intersecting the floor surface at a bottom end and extending upward therefrom to a top end; and at least one of the side panels having a serpentine configuration, comprising a series of inwardly opening, substantially vertically extending depressions integrally formed with and extending into the one side panel, each depression defined by depression sidewalls sized to receive and support an inverted glass and maintain the glass in an inverted condition within the one side panel, whereby water from the inverted glass is directed to the chamber floor surface; and the bottom floor surihce comprising a raised central portion and a side portion that slopes downward to the one side panel, and the bottom floor surface having a plurality of passageways extending therethrough located below the one side panel depressions and channeling the water from the inverted glass through the rack floor surface to an underside surface.

10. A rack according to claim 9, wherein the passageways are located proximate the intersection of the one side panel bottom end and the floor surface.

11. A rack according to claim 10, wherein the depression sidewalls flare outwardly from a bottom end to a top end and support the inverted glass in a tilted orientation, whereby the water from the glass exits along an outwardly located inward surface of the glass.

12. A rack according to claim 11, wherein the depression sidewalls are concave and smooth.

13. A rack according to claim 12, wherein the rack body further including dish supporting means located upon the central floor portion for supporting a plurality of dishware items.

14. A dish draining rack comprising:

a rack body for containing assorted dishware, the rack body having a central, upwardly opening dishware receiving chamber extending from a top rim to a floor surface and defined along opposite sides by a tirst side panel and a second side panel, the side panels intersecting a respective side portion of the floor surface at a bottom end and extending upwardly therefrom to a top end; and each of the side panels having a serpentine configuration, comprising a series of inwardly opening, substantially vertically extending depressions integrally formed with and extending into the side panel, and each depression is defined by depression sidewalls sized to receive and support an inverted glass and maintain the glass in an inverted condition within the one side panel, whereby water from the inverted glass is directed to the chamber floor surface; and the bottom floor surface having a downwardly concave configuration, comprising a raised central portion, the side portions of the floor surface sloping downward from the central portion to the side panels, the floor surface side portions having a plurality of passageways extending therethrough located below respective side panel depressions and chromeling the water from the inverted glass through the rack floor surface to an underside surface.

15. A rack according to claim 14, wherein the sidewalls of the depressions are concave and the depressions extend continuously in side by side relationship from a forward end to a rearward end of the sidewalls.

16. A rack according to claim 15, wherein the depression sidewalls flare outwardly from a bottom end to a top end and support the inverted glass in a tilted orientation, whereby the water from the glass exits the glass along an outwardly located inward surface of the glass.

* * * * *

UNITED STATES PATENT AND TRADEMARK OFFICE

CERTIFICATE OF CORRECTION

PATENT NO. : 5,588,539
DATED : December 31, 1996
INVENTOR(S) : Dennis D. Belden, et al.

It is certified that error appears in the above-indentified patent and that said Letters Patent is hereby corrected as shown below:

Column 2, Line 49, add the number --12-- after "chamber" and before "that".

Column 4, Line 36, delete the punctuation "." after the word "central" and substitute therefor the punctuation --,--.

Column 4, Lines 39 and 40, delete the word "imersecting" and substitute therefor the word --intersecting--.

Column 4, Line 43, delete the word "imegrally" and substitute therefor the word --integrally--.

Column 5, Line 34, delete the word "surihce" and substitute therefor the word --surface--.

Column 6, Line 13, delete the word "tirst" and substitute therefor the word --first--.

UNITED STATES PATENT AND TRADEMARK OFFICE

CERTIFICATE OF CORRECTION

PATENT NO. : 5,588,539
DATED : December 31, 1996
INVENTOR(S) : Dennis D. Belden, et al.

It is certified that error appears in the above-indentified patent and that said Letters Patent is hereby corrected as shown below:

Column 6, Line 32, delete the word "chromeling" and substitute therefor the word --channeling--.

Signed and Sealed this

Twenty-fourth Day of June, 1997

Bruce Lehman

*Attest:*

BRUCE LEHMAN

*Attesting Officer*

*Commissioner of Patents and Trademarks*